US006036018A

United States Patent [19]

Harrold

[11] Patent Number: 6,036,018

[45] Date of Patent: Mar. 14, 2000

[54] MULTI-DRAWER CHILD RESISTANT BLISTER PACK CONTAINER

[75] Inventor: George E. Harrold, Bloomsbury, N.J.

[73] Assignee: Valley Design Inc., Bloomsbury, N.J.

[21] Appl. No.: 09/314,341

[22] Filed: May 19, 1999

[51] Int. Cl.[7] ..... B65D 83/04

[52] U.S. Cl. ..... 206/536; 206/1.5; 206/499

[58] Field of Search ..... 206/528, 535, 206/536, 499, 807, 1.5

[56] References Cited

U.S. PATENT DOCUMENTS

| | | | |
|---|---|---|---|
| B 536,923 | 3/1976 | Mayled | 206/1.5 |
| 3,429,426 | 2/1969 | Wolf et al. | 206/42 |
| 3,888,350 | 6/1975 | Horvath | 206/531 |
| 3,897,855 | 8/1975 | Patterson | 206/535 |
| 3,942,630 | 3/1976 | Phillips | 206/1.5 |
| 4,113,332 | 9/1978 | McMaster | 312/204 |
| 4,192,422 | 3/1980 | Kotyuk | 206/528 |
| 4,485,915 | 12/1984 | Berghahn | 206/1.5 |
| 4,817,819 | 4/1989 | Kelly | 221/2 |
| 4,889,238 | 12/1989 | Batchelor | 206/535 |
| 5,082,137 | 1/1992 | Weinstein | 220/346 |
| 5,275,291 | 1/1994 | Sledge | 206/531 |
| 5,368,187 | 11/1994 | Poncetta et al. | 221/30 |
| 5,377,839 | 1/1995 | Relyea et al. | 206/531 |
| 5,878,887 | 3/1999 | Parker et al. | 206/528 |

*Primary Examiner*—Jacob K. Ackun
*Attorney, Agent, or Firm*—Kenneth P. Glynn, Esq.

[57] ABSTRACT

The present invention is a child resistant safety container for blister packs with a housing with an opening, and slides located inside the housing which position and retain several drawers inserted into the opening. A latching mechanism is provided to engage and retain each of the drawers when inserted into the housing. The latching mechanism has cooperating male and female parts located on the drawer and the housing in positions complimentary to each other. The part located on the housing is functionally operable with a latching trigger slidably connected to the housing. Resilient living springs are provided to urge each of the drawers into latching engagement and, when a drawer is pushed in against the spring, moves to partially disengages the drawer. The latching trigger moves the latching mechanism into a second position fully disengaging the drawer for removal. The remainder of the drawers which have not been pushed in remain retained in the safety container by the latching means.

20 Claims, 4 Drawing Sheets

MULTI-DRAWER CHILD RESISTANT BLISTER PACK CONTAINER

BACKGROUND OF THE INVENTION

1. Field of the Invention

The present invention is a child resistant safety container which stored drawers of medicine dispensing blister packs. A compound motion, involving pushing a drawer inward, combined with moving a latching trigger located on the exterior of the safety container, is require to release a blister pack.

2. Information Disclosure Statement

U.S. Pat. No. B 536,923 to Edward Mayled describes a package having an improved means for releasably retaining the components of the package in assembly. Known similar package constructions require the use of additional material and necessitate the performance of additional manufacturing operations in order to provide closure flaps situated at opposite ends of a sleeve which is adapted to support a removable tray therein. The package according to the subject invention is of relatively simple construction, as well as being more economical than known similar packages. According to the subject invention, the improved package comprises a container and an enclosure having at least one open end. The container is adapted to be inserted into or removed from the enclosure through at least one open end thereof. The container and the enclosure are of substantially equal dimension and have cooperating means adapted to provide a positive connection between the container and the enclosure whereby the container is releasably retained within the enclosure until the cooperating means are disengaged by a user.

U.S. Pat. No. 3,429,426 to Otto Wolf and Otto Weller describe a package for discrete articles. An outer sleeve of substantially rectangular cross-section has at least one open end. An inner receptacle is slidably received in the outer sleeve and comprises a first member which has a side provided with at least one open recess, and a second recess which overlies this side and is sealingly connected to the first member so as to define with this open recess a sealed chamber within which an article to be packaged is to be accommodated.

U.S. Pat. No. 3,888,350 to William Horvath describes a snap lock and squeeze open slide top container that has a small centered catch depending from the inner face of the cover. The edge of the catch forms with the closed end of the cover a slot which accommodates the rear edge of the drawer portion of the container. The profile of the catch is tapered, forming an inclined plane directed to the front end of the container. The cover and drawer are slidably engaged by lateral meshing flanges which are interrupted near the closed end to provide slight clearances between the inside of the cover and the outside of the drawer. These clearances, together with an inverted V-shaped cut centered in the rear skirt of the cover, permit the cover to bow up when the sides are squeezed, releasing the edge of the drawer portion from the slot formed by the catch, to open the drawer. When the drawer is closed, the edge portion rides forward along the inclined plane depending from the cover, engaging the slot with a click, to lock the container closed. To prevent spillage, the opening of the drawer is limited by a pair of small stops depending from the inner face if the cover near each sidewall, which ride in elongated recesses in the lateral walls.

U.S. Pat. No. 3,942,630 to Otto Phillips describes a sliding cover safety package including a container having a cover mounted thereon for slidable movement between open and closed positions with respect to the container. The container and cover are provided with locking lugs having a locked position when the cover is closed in which the cover is locked against movement from its closed position with respect to the container, and an unlocked position when the cover is closed in which the cover is locked against movement from its closed position with respect to the container, and an unlocked position when the cover is closed in which the cover can slide with respect to the container to its open position. The locking lugs are moveable between the locked and unlocked positions by axial movement of the cover with respect to the container. Resilient biasing members is engaged between the container and cover to bias the locking lugs to the locked position such that the cover can slide from its closed position with respect to the container only after axial movement of the cover with respect to the container against the biasing members.

U.S. Pat. No. 4,113,332 to James David McMaster describes a secret compartment case having a flexible housing, an inner drawer and an outer drawer, the flexible housing having a release member formed therewith for operatively connecting the inner drawer with the housing, the inner drawer being releasable from the housing to allow movement from a secured to an unsecured position when the outer drawer is moved from the shut position.

U.S. Pat. No. 4,192,422 to Bernard Kotyuk describes a pill package of the type including child-proof features makes use of the standard blister card for mounting the pills. A plastic shield is constructed to provide a slidable mating relationship with the blister card in an unlocked position and the car and shield together defining locking means wherein both locked and unlocked positions can be assumed between the card and the shield. As in all conventional blister cards, an access means construction is included, but in the structure of the present invention, the access means is unexposed when the card and shield are in the locked position.

U.S. Pat. No. 4,485,915 to Walter G. Berghahn describes a child resistant package having an outer container and an inner product supporting tray; the inner tray is adapted to be inserted into the container to a locked position and removed therefrom by disengaging a locking means and withdrawing the tray; the inner tray is disengaged from the container by pressing inwardly a pair of flexible tabs formed at the back end of the side walls of the tray; in a preferred embodiment a blister pack containing tablets is disposed on the product tray and the tray bottom is provided with holes through which the tablets in the blister pack may be pushed.

U.S. Pat. No. 4,817,819 to Thomas K. Kelly describes a tablet container having a cover and a sliding tray is used for dispensing birth control tablets for either a twenty-one-day ar twenty-eight-day cycle. Normally, the tray does not slide completely out of the cover and is stabilized with respect thereto when open. The case resembles a cosmetics compact and is reusable in that once birth control tablets contained in a blister pack are used up, a new blister pack may easily be inserted.

U.S. Pat. No. 5,082,137 to Jack Weinstein describes an invention directed toward a child resistant locking slide box that is opened by deforming a locking tab on the slide box drawer that positively engages the surrounding cover. There are tracks on the inside surfaces of the cover side walls that positively engage and slide along tracks positioned on the outside surfaces of the drawer side walls. The engagement of the cover and draw tracks allow only for the respective lateral movement of the cover across the drawer. The lateral movement of the cover allowed by the tracks is restricted in one direction by the cover end tabs, and in the other direction by the drawer locking tab.

The drawer locking tab has a step that overlaps the cover surface. To open the slid box the cover tab must first be deformed backward, removing the step from above the cover, and then downward so that the whole locking tab is beneath the cover. Once the draw tab is below the cover, the drawer can be pushed past the cover, exposing the contents of the drawer.

U.S. Pat. No. 5,275,291 to Larry C. Sledge describes a child-resistant, elderly friendly dispensing container which comprises a housing having an opening in its top wall and a drawer which slidably fits into the housing. The drawer has a front cavity section and a rear latch section. The latch section includes a horizontally disposed resilient panel formed with an upward button which, when the drawer is closed, extend up through the opening in the top wall of the housing and forms an automatic latch, holding the drawer closed. In order to open the drawer, the button bust be depressed and, at the same time, the drawer must be pulled out from the housing. The top of the housing is formed, adjacent the opening for the button, with a relief zone into which the button moves when the drawer is in dispensing position and blocks further opening.

U.S. Pat. No. 5,368,187 to Stanley Poncetta et al describes a dispenser and method for dispensing material from a blister pack of one or more blister cards. A single blister card having a plurality of blisters thereon can be used with other blister cards in a stack. To dispense materials from the aligned blisters of stacked blister cards, a plunger is driven through a guide hole in a top plate and into aligned blisters of a stack of blister cards. In this way, a plurality of blisters can be quickly and cleanly opened. Thus, a plurality of medical pills can be liberated from the blister and can easily gravitate to a collection region below the stack of blister cards. Several embodiments of the mount for the blister card stack is disclosed.

U.S. Pat. No. 5,377,839 to Chrystopher M. Reylea et al describes an improved exchangeable medicament dosing system and method which includes a reusable integral patent dispensing frame which supports a plurality of reusable cartridges. Replaceable blister packages having a plurality of individually sealed spaced pockets are slidably inserted into the reusable cartridge and aligned with a predetermined number of dispensing openings therewhithin. The blister packages are specifically designed to mechanically interact with the cartridge as they are slidably inserted to properly align the spaced pockets with corresponding dispensing openings of the cartridge. One or more cartridges are releasably locked at least partially within the dispensing frame, and a plurality of dispensing frames can be placed in a frame container for convenient exchange and use with medication carts. The resulting dosing system and method combines the advantages of punch card distribution with its excellent visual accountability and seal, with the benefits of a perpetual inventory exchange system.

U.S. Pat. No. 5,878,887 to Kathleen Alek Parker et al describes a child-resistant blister package having a tray adapted to receive a blister card with at least one blister compartment is provided. The tray includes a first slide component. A cover having a top and a second slide component is provided. The second slide component is complimentary to and slidingly engaged with the first slide component. The second slide component is connected to the top of the cover such that the cover can be slidably displaced relative to the tray between the first position, in which the top of the cover substantially overlies the tray and is adapted to prevent access to the blister card, and a second position, in which the cover is displaced at least partially from the tray such that the blister card is exposed. A tab is connected to the cover, and one of a locking projection and a slot is located on the tab. The other of the slot and the locking projection is located on a first portion of the tray in a complimentary location to the locking projection when the cover is in the first position, such that the locking projection is engaged in the slot to limit relative movement of the cover with respect to the tray. One of the tab and the first portion of the tray is movable to a position in which the locking projection is disengaged from the slot to permit movement of the cover to the second position.

Notwithstanding the prior art in this field, it is believed that the present invention which teaches is neither taught nor rendered obvious.

SUMMARY OF THE INVENTION

The present invention is a child resistant safety container for blister packs comprising a housing with at least one open side and a plurality of slides located inside the housing which position and retain a plurality of drawers. The drawers are inserted into the open side of the housing on the slides located inside the housing.

A latching mechanism is provided to engage and retain each of the drawers when inserted into the housing. The latching mechanism has cooperating male and female parts, with one of the parts located on an outside surface of the drawer, and the other part located on the inside of the housing in a position complimentary to the outside surface of the drawer. The part located on the housing is functionally operable with the part on the outside surface of the drawer.

A latching trigger member is slidably connected to the housing in a position to functionally connect to and actuate the part of the latching mechanism located on the inside of the housing.

Resilient living springs are provided to urge each of the drawers into engagement with the latching mechanism and, when a drawer is pushed in against the spring, moves the latching mechanism into a first partially disengaging position.

The latching trigger member moves the latching mechanism for the drawer which is pushed in into a second fully disengaging position allowing the drawer to be removed from the safety container, while a remainder of said plurality of drawers which have not been pushed in remain retained in the safety container by the latching means.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

Figure 2:
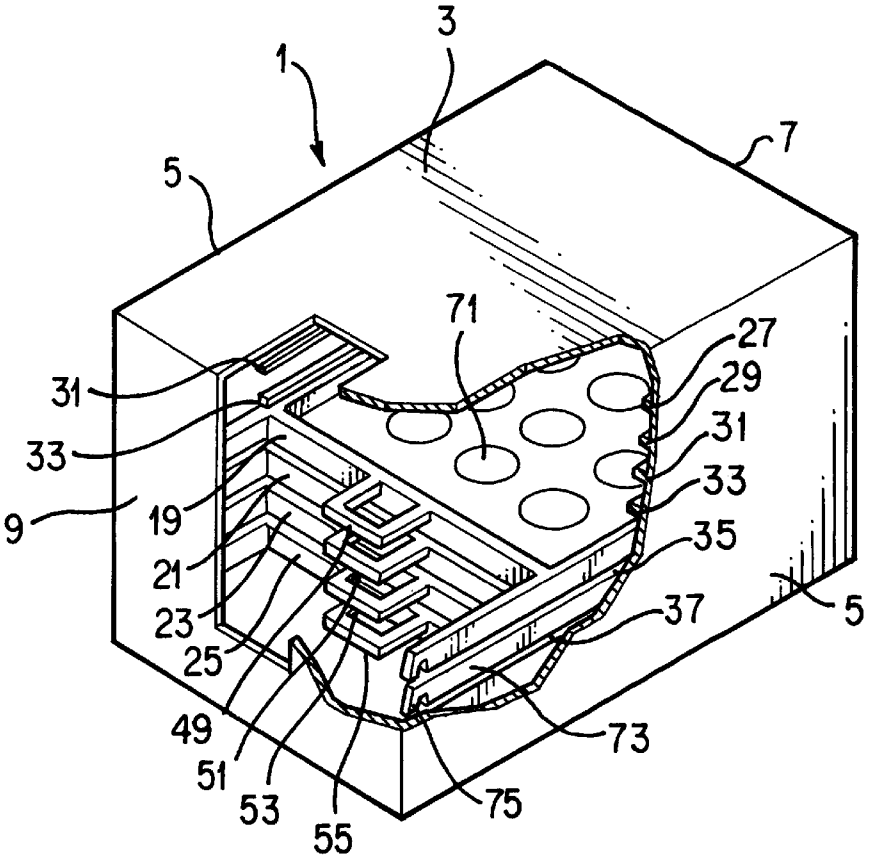
FIG. 2 is a cutaway of the perspective showing drawers of blister packs in the container.

The present invention is a child resistant safety container for blister packs.

Blister packs are commonly used to dispense medicines, and need to be protected from unsupervised access by children and others. In this invention a large number of blister packs can be safely stored in a container. Release of a blister pack from the safety container requires a compound motion not obvious to an untrained user of the safety container.

A safe blister pack safety container of this type will be useful in situations where larger amounts of medicines are distributed such as hospitals, clinics, nursing homes, doctors offices, and veterinary or other animal care facilities. The blister packs can be stored in this tamper resistant container and then easily released for use by a trained user of the safety container.

Drawers are used which are inserted into the safety container through one open surface. The safety container housing has slides on the inside surfaces which guide and position the drawers in the housing. An internal latching mechanism inside the safety container engages and retains the drawers inside the housing when the drawers are inserted. Resilient living springs are provided for each drawer which urge the drawers into engagement with the latching mechanism when the drawers are inserted. When the drawers are latched in place in the safety container, the blister packs are safe from tampering from outside the safety container.

A compound motion is required for release of the drawers. To release a drawer, the drawer is first pushed into the housing against the living springs. This positions the latch mechanism into a partially disengaged position. Then a trigger latching member located on the outside of the housing is moved to fully disengage the drawer. All other drawers not pushed in are retained by the latching mechanism in the housing.

A drawer with integral blister pack is described in the drawings. However, an empty drawer into which blister packs can be inserted for storage in the container can be used. The drawers can be marked to identify the medicine enclosed in the drawer at the open end of the container for future dispensing.

In the embodiment disclosed herein, a latching mechanism is shown which provides an individual latch for each drawer. The female part of the latch is a hole in a surface projecting from the side of the drawer. The male part is a hook attached to the latching trigger. The hole and hook are configured to cooperate for engagement and release. The hook is an extended member having the flexibility to allow motion of the latching mechanism to occur during drawer release as described below. The flexibility of the hook also provides a snapping action when a drawer is inserted into the safety container, indicating that the drawer has been properly latched.

Male and female parts are taken to mean two or more engaging parts which can be connected to each other and unconnected from one another in a locking fashion. Thus, while a hook and loop or orifice are shown in the drawings representing the male and female engaging latch parts shown in these embodiments, equivalent engaging parts such as hooks and pins, slots and sleeves, etc., could be used without exceeding the scope of the invention.

Figure 1:
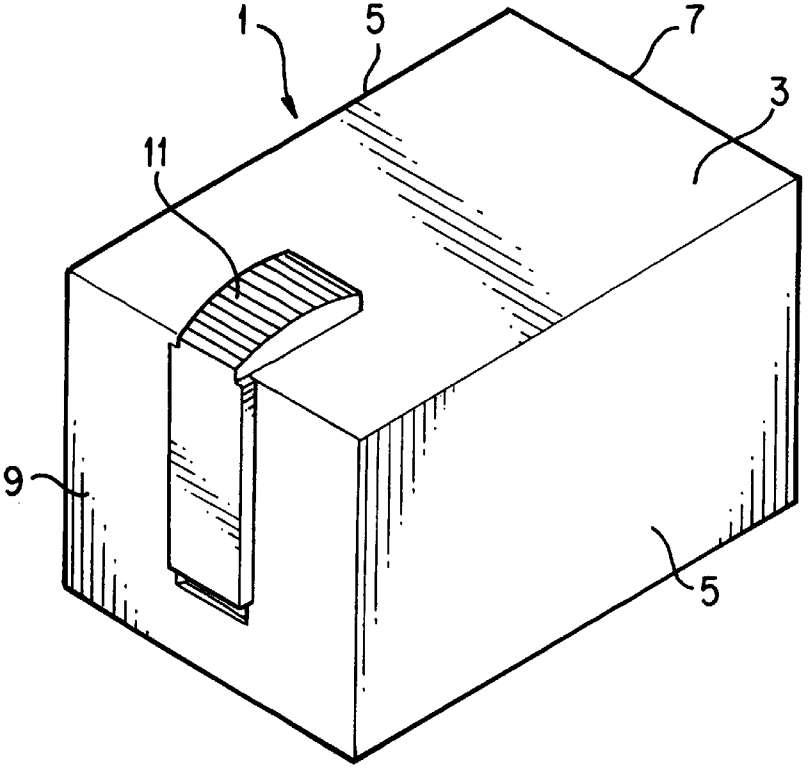
FIG. 1 perspective view of the safety container.

The present invention is detailed in FIGS. 1 through 6 with like elements or components being like numbered. A child resistant safety container with provision for seven drawers of blister packs is shown in FIGS. 1 through 4. FIG. 1 is a perspective view of the exterior of the safety container 1 showing the housing 3, the sides 5, the open front 7 where the drawers of blister packs are inserted into the container (not show in the perspective view), back 9 of the housing, and latching trigger 11 operable from the exterior of the container.

Figure 3:
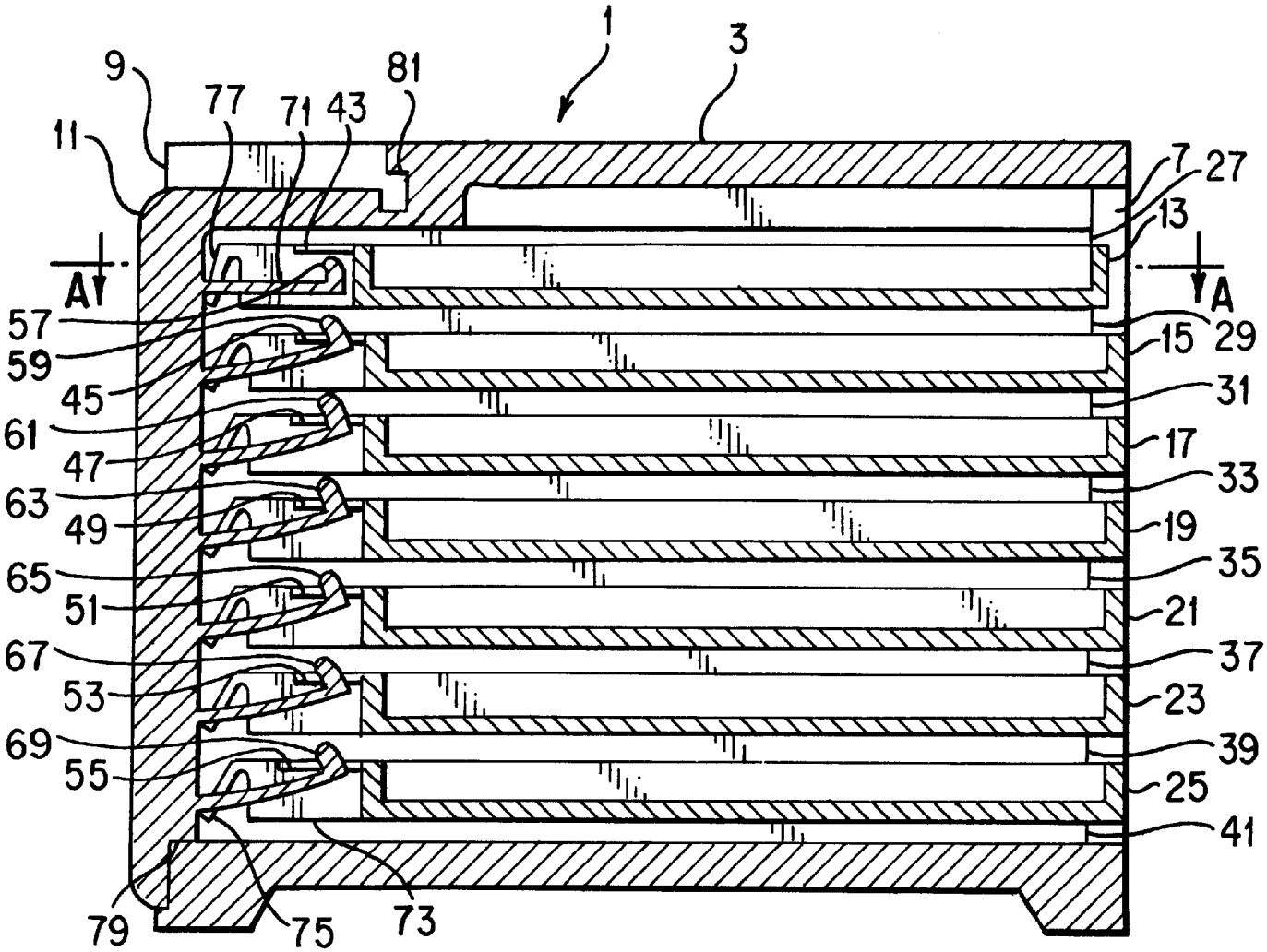
FIG. 3 is a section view of the side of the container showing the inside with drawers installed and latched in place and the top drawer partially removed.

FIG. 2 is a cutaway of the perspective view of container 1 with the latching trigger 11 removed, and FIG. 3 is a section view of the container 1, both showing a safety container with seven drawers 13, 15, 17, 19, 21, 23, and 25 installed through open front 7 of housing 3. In FIG. 2 the top three drawers have been removed showing the inside of drawer 21 with medication retaining blisters shown typically at 71. The drawers are positioned on slides 27, 29, 31, 33, 35, 37, 39, and 41 located on opposite sides 5 of the housing 3. The female part of the latching mechanism is shown as a surface projecting forward from the rear of the drawers with a square hole in the surface at 43, 45, 47, 49, 51, and 55. The drawers also have rearward projecting extensions 73 with living springs on the ends of projections 73 as shown typically at 75 on drawer 25 and 77 on drawer 13 in FIG. 3, and at 75 on drawer 21 in FIG. 2.

The latching trigger 11 mounted in back 9 of housing 3 has integral male latching hooks 57, 59, 61, 63, 65, 67, and 69 which engage with mating female latch parts 43 through 55 on drawers 13 through 25 as shown on FIG. 3. The latching hooks have an extended length for flexibility typically as shown at 71 on hook 57.

In FIG. 3 the compound motions used to remove a drawer are described. In this illustration drawer 13 is shown pushed in against living spring 77, the first of the compound motions. This action moves female latch part 43 into a disengaged position with hook part 57. Then, when latching trigger 11 is moved to its downward position against stop 79 on housing 3, the second of the compound motions required for release of a drawer, hook part 57 is moved downward to a position out of engagement with female part 43. The latch mechanism for drawer 13 is then in a disengaged position and the drawer can be released. The living spring 77 will urge the drawer out of housing 3 when it is released.

The remainder of the drawers, 15 through 25, not having pushed in, are shown in engagement with their respective latch mechanism parts, female parts 45 through 55 and male hook parts 59 through 69. The hook latching parts are shown bent upwards, their flexible extensions, as shown at 71 on hook part 57, allowing this movement, which allows the latching mechanisms for drawers 15 through 25 to remain engaged when the latching trigger 11 is moved to its downward position against stop 79 on housing 3. Also, the living springs are shown partially deflected to maintain engagement of the latching mechanisms for drawers 15 through 25, shown typically at living spring 75 on drawer 25. The living springs, as shown at 75 and 77 act against the inside surface of back 9 of housing 3.

Figure 4:
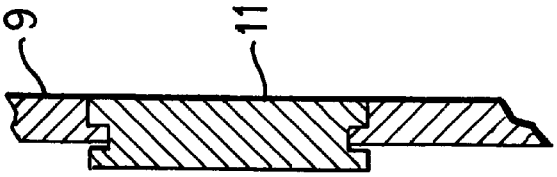
FIGS. 4 and 5 show alternative embodiments of the blister pack drawers.

The normal position of the latching trigger is in its upward position against stop 81 on housing 3. FIG. 4 is a section view at A of FIG. 3 showing the slidable mounting of latching trigger 11 in the back 9 of housing 3.

Figure 5:
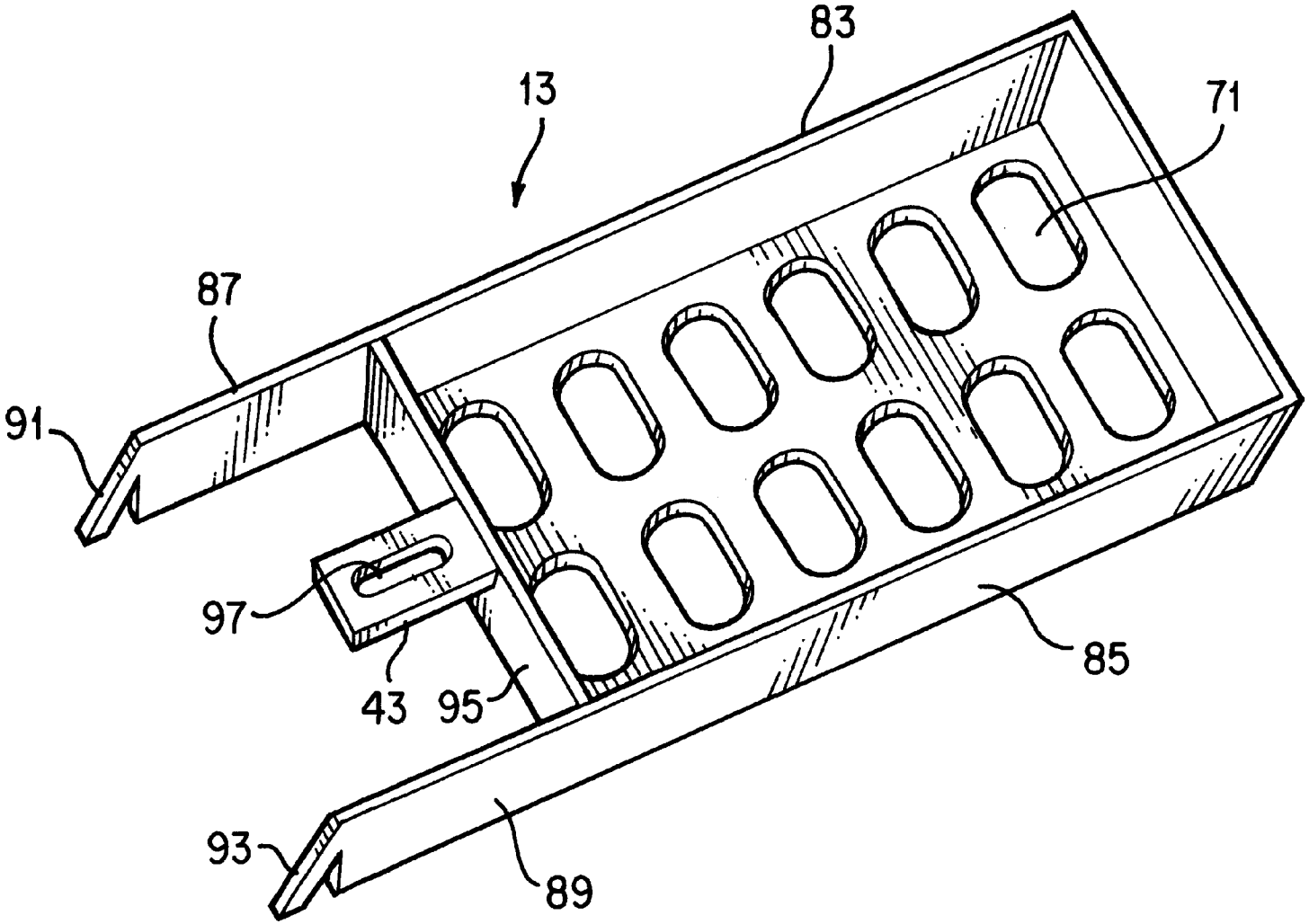

FIG. 5 shows an individual drawer, such as drawer 13 of FIG. 3, with an integral blister pack. A typical blister for containing medicines is shown at 71. The drawer has sides 83 and 85 which cooperate with slides 27 and 29 on sides 5 of housing 3 to slidably retain drawer 13 in the safety container 1. The sides 83 and 85 have forward projections 87 and 89 with living springs 91 and 93 on the rear of the extensions. The female part of the latching mechanism for drawer 13 is shown as rearward projecting surface 43 on rear surface 95 of the drawer 13, with hole 97 for engagement with the mating latching hook part 57.

Figure 6:
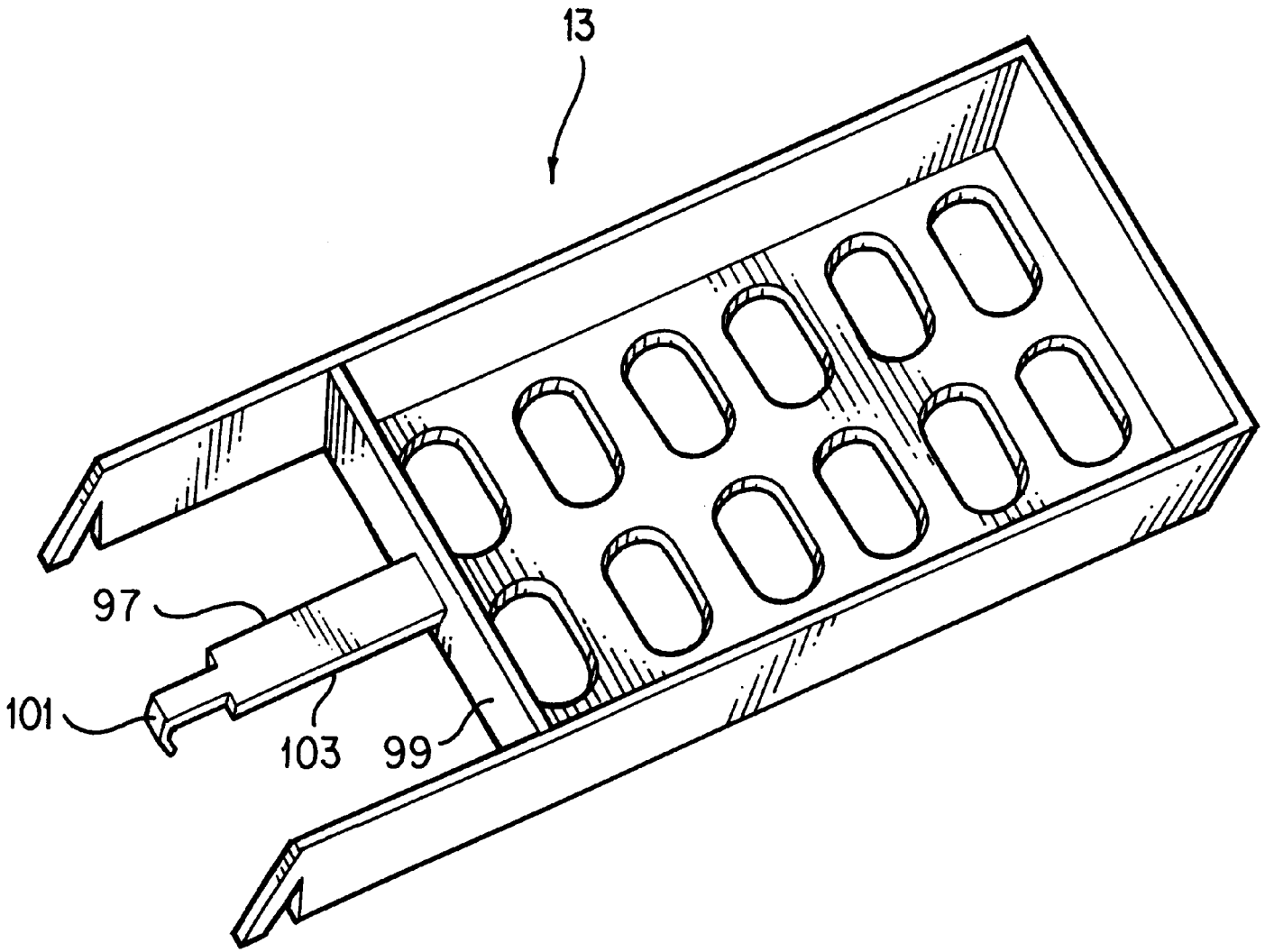
FIG. 6 shows the mounting of the latching trigger.

An alternative embodiment of the latching mechanism is shown on the modified configuration of a drawer, such as drawer 13 of FIG. 3, in FIG. 6. The drawer in this embodiment is identical to the drawer configuration shown in FIG. 5 except that a different arrangement of the latching mechanism parts is shown. In this embodiment, the hook part 97 is on the rear surface 99 of drawer 13, including hook 101 to engage the mating female latching part, which, in this embodiment, is located on the latching trigger. The hook part also has flexible extension 103 extending from rear surface 99.

Although it is not a critical feature of the present invention, for practical reasons, in preferred embodiments, some stop mechanism would be included to provide a retained position of the drawers within the housing when they are almost all the way removed from the housing. In this position, the blister pack in the drawer would be exposed for removal of the medicines contained therein.

Obviously, numerous modifications and variations of the present invention are possible in light of the above teachings. It is therefore understood that within the scope of the appended claims, the invention may be practiced otherwise than as specifically described herein.

What is claimed is:

1. A child resistant safety container for blister packs comprising;

a housing with at least one open side, and a plurality of slides located inside said housing which position and retain a plurality of drawers, said plurality of drawers inserted into said at least one open side of said housing on said slides located inside said housing, a latching means to engage and retain each of said plurality of drawers when inserted into said housing, said latching means having cooperating male and female parts with one of said male and female parts located on an outside surface of said drawer and the other of said male and female parts located on the inside of said housing in a position complimentary to said outside surface of said drawer and functionally operable with said one of said male and female parts on said outside surface of said drawer, a latching trigger member slidably connected to said housing in a position to functionally connect to and actuate one of said male and female parts of said latching means located on said inside of said housing, resilient means to urge each of said plurality of drawers into engagement with said latching means and, when said drawer is pushed in against said resilient means, moves said latching means into a first partially disengaging position, and, wherein said latching trigger member moves said latching means for said drawer which is pushed in into a second fully disengaging position allowing said drawer to be removed from said container, while a remainder of said plurality of drawers which have not been pushed in remain retained in said container by said latching means.

2. The container of claim 1 wherein said latching means has flexibility to snap into engagement with each of said drawers when said drawers are slidably inserted into said container and engage said latching means.

3. The container of claim 1 wherein said drawer is made as a blister pack for dispensing medicine and integrally contains said male and female parts of said latching means on said outside of said drawer and cooperates with said resilient means.

4. The safety container of claim 1 wherein said male and female parts of said latching means is a hook and an orifice formed in a surface and shaped to cooperate with said hook.

5. The latching means of claim 4 wherein said hook is semiflexible and configured to snap into engagement with said orifice.

6. The latching means of claim 4 which requires a compound motion for release, the first releasing motion being to move said hook to a position within said orifice not engaged with the surfaces of said orifice surrounding said hook, and the second being to move said hook out of engagement with said orifice.

7. The latching means of claim 6 wherein said first releasing motion is accomplished by pushing said drawer against said resilient means.

8. The latching means of claim 6 wherein said second release motion is accomplished by moving said latching trigger member.

9. The latching means of claim 4 wherein said hook is on said housing and functionally connected to said latching trigger member and said orifice is in said outside surface of said drawer and shaped to cooperate with said hook.

10. The latching means of claim 9 wherein said hook is semiflexible and configured to snap into engagement with said orifice.

11. The latching means of claim 9 which requires a compound motion for release, the first releasing motion being to move said hook to a position within said orifice not engaged with the surfaces of said orifice surrounding said hook, and the second being to move said hook out of engagement with said orifice.

12. The latching means of claim 11 wherein said first releasing motion is accomplished by pushing said drawer against said resilient means.

13. The latching means of claim 11 wherein said second release motion is accomplished by moving said latching trigger member.

14. The latching means of claim 4 wherein said hook is on said drawer and said orifice is on said housing and functionally connected to said latching trigger member.

15. The latching means of claim 14 wherein said hook is semiflexible and configured to snap into engagement with said orifice.

16. The latching means of claim 14 which requires a compound motion for release, the first releasing motion being to move said hook to a position within said orifice not engaged with the surfaces of said orifice surrounding said hook, and the second being to move said hook out of engagement with said orifice.

17. The latching means of claim 16 wherein said first releasing motion is accomplished by pushing said drawer against said resilient means.

18. The latching means of claim 16 wherein said second release motion is accomplished by moving said latching trigger member.

19. The latching trigger member of claim 1 wherein one of said male and female parts not connected to said drawers is unistructurally formed with said latching trigger member.

20. The safety container of claim 1 wherein said safety container further includes a tamper evidencing enclosure encasing said housing.

* * * * *